US006625847B1

(12) United States Patent
Jones

(10) Patent No.: US 6,625,847 B1
(45) Date of Patent: Sep. 30, 2003

(54) DOOR CLOSERS

(75) Inventor: Barrie Jones, Weston-under-Lizard (GB)

(73) Assignee: Samuel Heath & Sons PLC, Birmingham (GB)

( * ) Notice: Subject to any disclaimer, the term of this patent is extended or adjusted under 35 U.S.C. 154(b) by 0 days.

(21) Appl. No.: 09/914,652

(22) PCT Filed: Mar. 1, 2000

(86) PCT No.: PCT/GB00/00717

§ 371 (c)(1),
(2), (4) Date: Jan. 14, 2002

(87) PCT Pub. No.: WO00/52291

PCT Pub. Date: Sep. 8, 2000

(30) Foreign Application Priority Data

Mar. 4, 1999 (GB) ..... 9904845

(51) Int. Cl.[7] ..... E05F 3/00

(52) U.S. Cl. ..... 16/51; 16/54; 16/56; 16/61; 16/72; 16/59; 16/68

(58) Field of Search ..... 16/54, 56, 50, 16/51, 59, 68, 72, 76, 71, 85, 86 C, 61

(56) References Cited

U.S. PATENT DOCUMENTS

| | | | | | |
|---|---|---|---|---|---|
| 1,239,510 | A | * | 9/1917 | Nordquist | 16/51 |
| 2,437,192 | A | * | 3/1948 | Glanz | 16/50 |
| 2,602,662 | A | | 7/1952 | Kintzinger | |
| 3,372,427 | A | * | 3/1968 | Koivusalo | 16/68 |
| 3,449,788 | A | * | 6/1969 | Wake | 16/54 |
| 3,887,961 | A | * | 6/1975 | Saajos | 16/56 |
| 4,102,006 | A | * | 7/1978 | Jenkins | 16/51 |
| 4,317,254 | A | * | 3/1982 | Chaddock | 16/61 |
| 4,760,621 | A | * | 8/1988 | Stromquist | 16/85 |
| 5,016,317 | A | * | 5/1991 | Hung | 16/54 |
| 5,706,551 | A | * | 1/1998 | Jeynes et al. | 16/59 |

FOREIGN PATENT DOCUMENTS

| | | | |
|---|---|---|---|
| DE | 17 08 349 | | 5/1971 |
| DE | 33 23 063 | | 1/1985 |
| DE | 4005386 | A1 * | 8/1991 |
| DE | 195 13 434 | | 10/1996 |
| DE | 297 04 103 | | 7/1998 |
| EP | 0 0616 445 | | 10/1980 |
| EP | 0332426 | A1 * | 9/1989 |
| FR | 2 566 827 | | 1/1986 |
| GB | 1497220 | * | 1/1978 |
| GB | 2167121 | A * | 5/1986 |
| WO | WO 96/05397 | | 2/1996 |

* cited by examiner

*Primary Examiner*—Chuck Y. Mah
(74) *Attorney, Agent, or Firm*—Baker Botts LLP

(57) ABSTRACT

A door closer comprises an actuator assembly (20) adapted for fitting within the thickness of a door and an anchor member (10) adapted for fitting in a door frame in opposed relation to said edge face of the door. An operating member (30) is driven by spring means (45) and coupled to said anchor member (10) to draw the door towards the door frame. An adjustable fluid-filled damper (50) is coupled to said operating member (30) and arranged to provide variable regulation the rate of movement of the operating member under the force of said spring means (45). Resilient thrust means (85) are arranged to exert an increased driving force of said operating member (30) and adjustable control means (100) are provided whereby said thrust means (85) is operative to augment the driving force to said operating member (30) over a defined but variable part of said range of movement corresponding to movement of the door over the final part of its movement into its closed position.

15 Claims, 7 Drawing Sheets

DOOR CLOSERS

DESCRIPTION OF INVENTION

This invention concerns door closers of the kind comprising an actuator assembly intended for concealed fitting within the thickness of a door, and an anchor member for fixing to a door frame, and in which an operating member is coupled to said anchor member and is movable within the actuator assembly under the action of driving means, usually comprising one or more mechanical springs, and under the control of a uni-directionally operative fluid-filled damper which serves to regulate the rate of movement of the door in the direction of closure without significantly restricting the rate of movement of the door in the direction of opening.

It is desirable for the action of any damper in such a door closer to be adjustable so as to enable the rate of closure to be set to fall within a chosen range despite variations in the weight and other parameters of different doors with which the closer may be used, and for the closer to provide an augmented closing force as the door reaches its closed position in order to overcome resistance from any latch fitted to the door.

GB 2 044 840 A discloses such a door closer, which comprises an actuating assembly which is disposed in a housing that is located within the thickness of the door, having an operating member which is movable linearly by means of one or more coil springs, and coupled by a flexible linkage to the anchor member which is attached to the door frame.

EP 0 016 445 A discloses a door closer of this type in which adjustment of the final part of the closure movement of the door is achieved by means of an adjustment member associated with the anchor member which is attached to the door frame, the adjustment member being disposed behind a mounting plate of the anchor member at a variable spacing so as effectively to adjust the length of the coupling between the anchor member and the operating member in the actuator assembly. This arrangement does not make any provision for adjustment of the overall rate of closure, but only in the final closure position of the door relative to a final part of the travel of the piston in the door-closing direction, in which final part of the travel the action of the damper is rendered ineffective so as to provide for a locally increased rate of closure movement to overcome any resistance which may be offered by a door latch for example.

Although the rate of movement of the door as it approaches its position of closure is increased, there is no provision for adjusting the driving force applied to the door over the final part of closure movement, as relieving the effect of the damper does not increase the force applied by the driving springs, but only allows the door to accelerate in response to the driving force and the closing action then relies on the momentum of the moving door to overcome latch resistance. However, the acceleration achieved depends on many variable factors, including the weight of the door, wind loading on the door, and frictional resistance in die hinges and in the latch itself etc., and accordingly such designs do not entirely address the problem of overcoming resistance associated with a door latch.

DE 1 708 349 A discloses a door closer having a main spring which acts over the full range of movement of a rod which is coupled by a link to and anchor member, and a supplementary spring arranged end to end with the main spring and effective to increase the driving force applied to the rod over the final part of the closure stroke, but without provision for varying the point at which the supplementary spring becomes effective.

Accordingly, it is an object of the present invention to make provision for an augmented closure force to come into play as the door approaches its position of closure, as compared with the force applied throughout the remainder of the range of movement, whilst providing for adjustment of the operation to suit a wide range of requirements not achieved previously.

According to a first aspect of the invention we provide a door closer comprising in combination:

an anchor member for mounting on a door frame, an actuator assembly for mounting within the thickness of a door which is hinged for movement between open and closed positions relative to said door frame, an operating member coupled by an articulated link to said anchor member and mounted in said actuator assembly for a range of movement between a retracted position in which said anchor member is held immediately adjacent to said actuator assembly and an extended position in which said anchor member is held in spaced relation to said actuator assembly, resilient driving means arranged to exert a driving force on said operating member in a manner such as to drive said operating member towards said retracted position and thereby draw said anchor member and said actuator assembly together such that, when installed, the door closer acts to draw the door into its closed position relative to the frame, a damper connected to said operating member so as to control the rate of movement of the operating member in at least a direction towards said retracted position, said damper comprising a cylinder containing hydraulic fluid, a piston rod carrying a piston which divides the cylinder into two chambers, and flow-restricting means to limit the rate of flow of hydraulic fluid flow one of said chambers to the other at least in one direction of fluid flow in response to movement of said operating member towards said retracted position, an adjustable throttle which comprises two elements in combination, the flow restriction imposed on the hydraulic fluid by said throttle being variable by relative positional adjustment of said two throttle elements, and an adjustment member to enable one of said throttle elements to be positionally adjusted relative to the other so as to vary the flow restriction imposed on the hydraulic fluid by said throttle, resilient thrust means arranged to exert an increased driving force on said operating member, and control means whereby said thrust means is operative to apply said increased driving force to said operating member over a defined part of said range of movement as said operating member approaches said retracted position, corresponding to movement of the door over the final part of its movement into its closed position, and an adjustment member operatively connected with said control means to vary the point in the range of movement of said operating member at which said resilient thrust means becomes operative to apply said increased driving force.

The control means preferably includes a detent means arranged to hold the thrust means in a stressed condition over the whole of the range of movement of the operating means apart from said defined part thereof.

In one arrangement, the thrust means may include a compression spring located within a guide member which is coupled to said operating means and slidable therewith along a fixed shaft, and the detent means may be mounted on a carrier member which abuts one end of the compression spring and is slidable on said fixed shaft and located on this said guide member for limited movement longitudinally thereof, the detent means being engagable in an internal recess formed within said guide member to hold the compression spring in a compressed condition, and being displaceable from said internal recess to release said compression spring at a predetermined position along said shaft.

The detent means may be displaceable from said position of engagement with said internal recess in said guide member into a position of engagement with an external recess formed in said shaft to hold said carrier member in a predetermined position on said shaft. Preferably, the detent means comprises a plurality of balls located in one or more transverse bores formed in the carrier member, and each of said balls is of a diameter greater than the radial spacing between said shaft and said guide member so that said balls are either held by said shaft in said internal recess in said guide member or by said guide member in said external recess in said shaft.

In a particularly preferred arrangement, the bores in which the balls are located are formed with a radially inner portion having a diameter such as to accept the ball with a slight clearance and a radially outer portion having a greater diameter, the two portions of the bore meeting at an internal shoulder which is located at a spacing from the shaft which is less than the radius of the ball. With this arrangement when the ball is held in the internal recess of the guide member, it has been found that the ball does not bind on the shaft, thereby allowing the shaft to move freely relative to the carrier.

In a preferred arrangement the cylinder of the damper is moveable relative to the actuator assembly and the piston is static, and the flow restriction means is incorporated into said piston and piston rod, and the adjustment member has an operating element which is accessible from one end of said piston rod.

The adjustment member may comprise a shaft located within an axial bore formed in said piston rod, with an external threaded formation engaging an internal threaded formation in the bore of the piston rod whereby rotation of the shaft varies its axial position within said bore. The shaft may be provided at one end with a needle formation which comprises one of said throttle elements to cooperate with an orifice defined by the other of said elements, and at its other end with a head formation whereby the shaft may be rotated.

The thrust means may comprise one or more spring elements having a higher rate than the resilient driving means. Preferably both the driving means and the thrust means comprise one or more coiled compression springs, but other arrangements are possible. For example the thrust means may comprise one or more stacks of Belville washers, and the driving means could comprise gas-springs.

In a particularly convenient arrangement, said thrust means and said driving means each comprise two elements disposed symmetrically relative to a single damper means, but other arrangements are possible.

These and other features of the invention will now be described by way of example with reference to the accompanying drawings wherein.

Figures 1A, 1B:
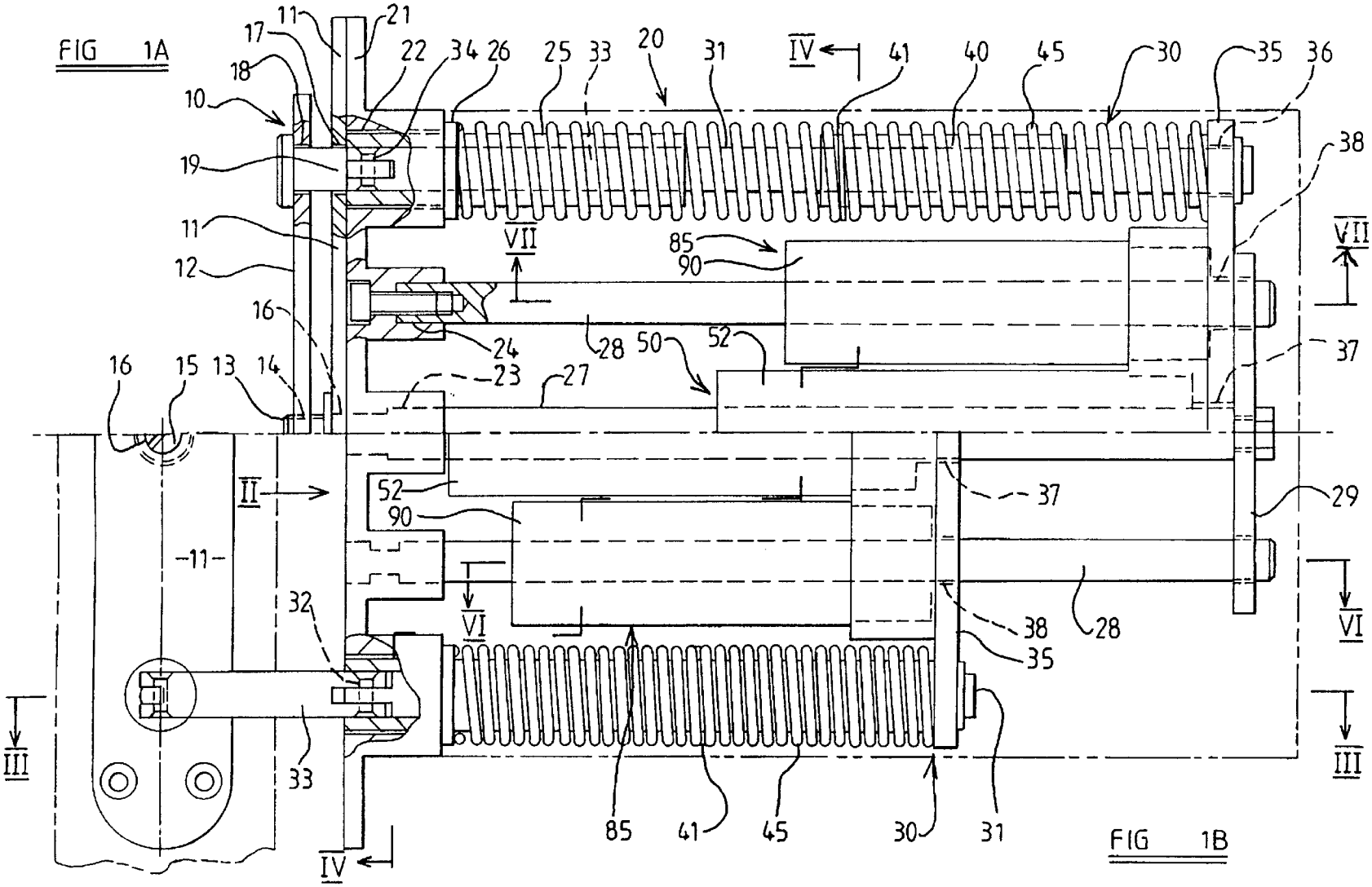
FIGS. 1A and 1B are partially sectioned side views of one embodiment of door closer to which the invention is applied, comprising an anchor assembly and an actuator assembly, and shown with these assemblies respectively in the "door closed" condition and in the "door open" condition.
Figure 2:
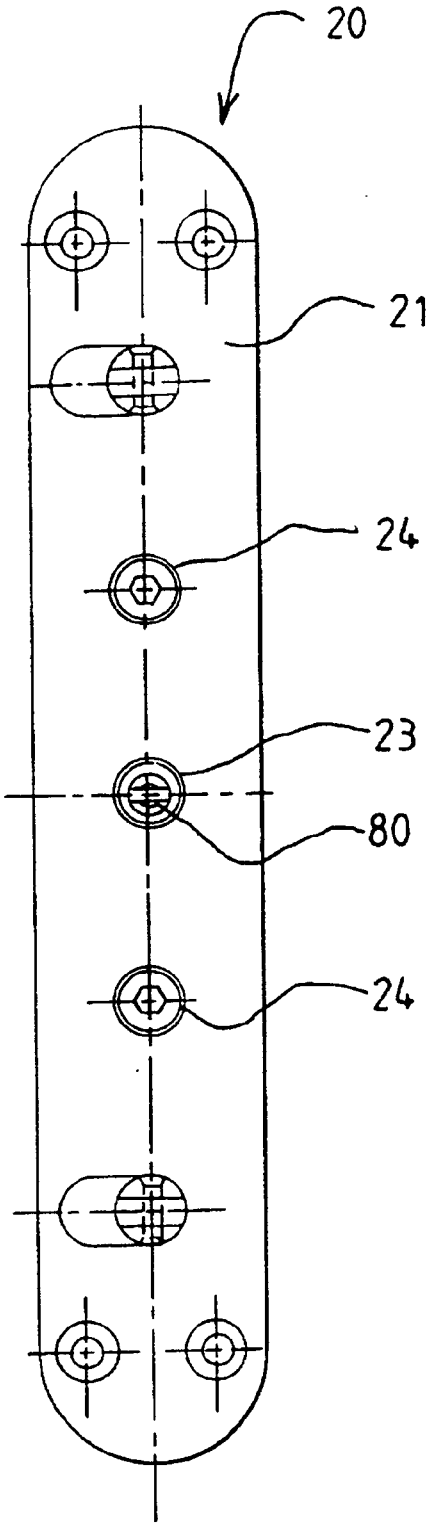
FIG. 2 is a front end view of the actuator assembly in the direction of arrow II of FIG. 1B.
Figure 4:
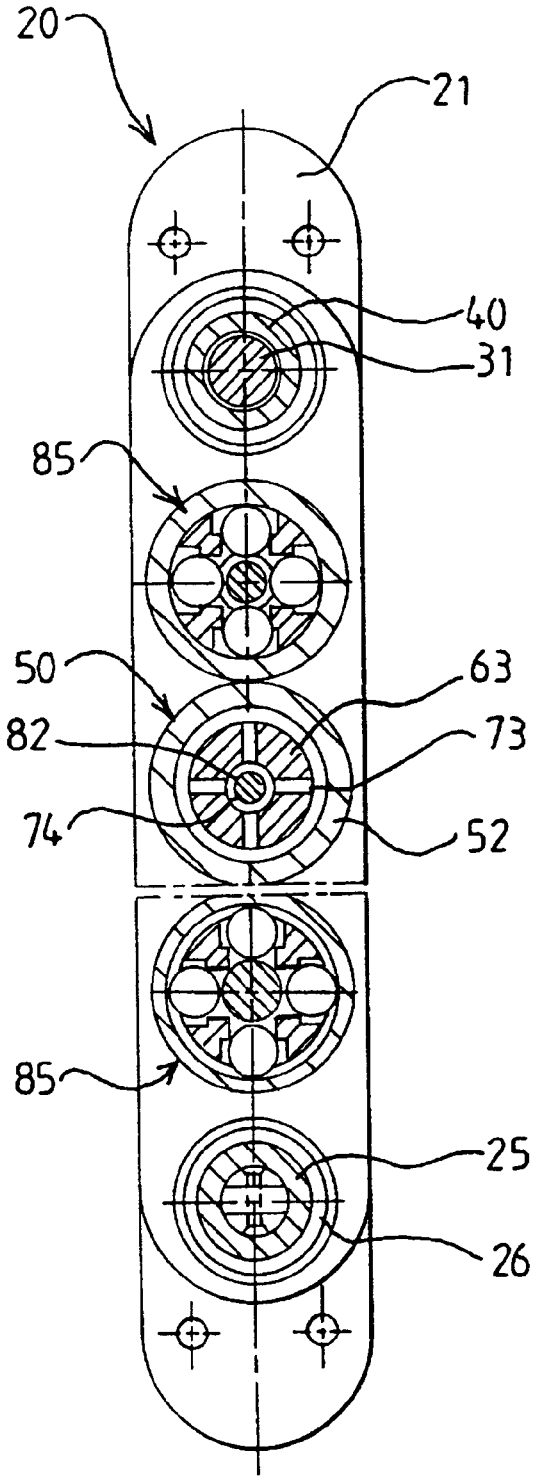
FIG. 4 is a composite section substantially on the line IV—IV of FIGS. 1A and 1B.
Figure 6:
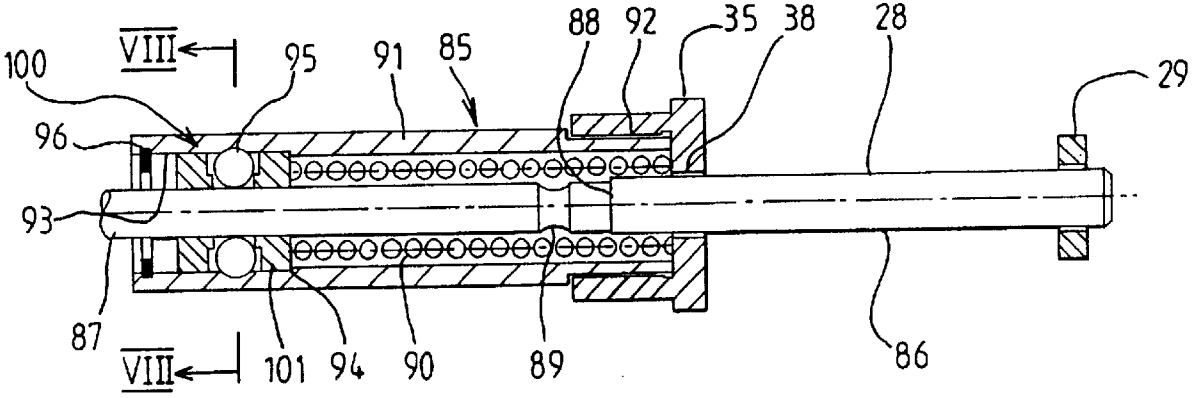
Figure 7:
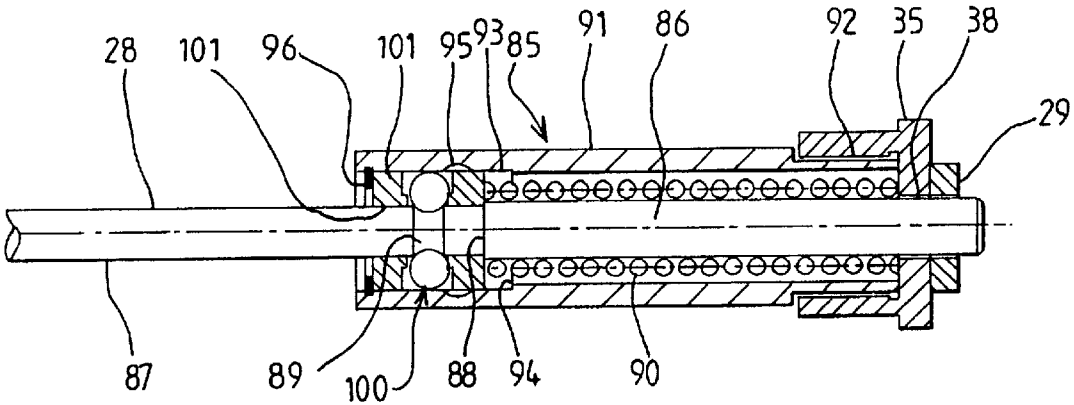
Figure 8:
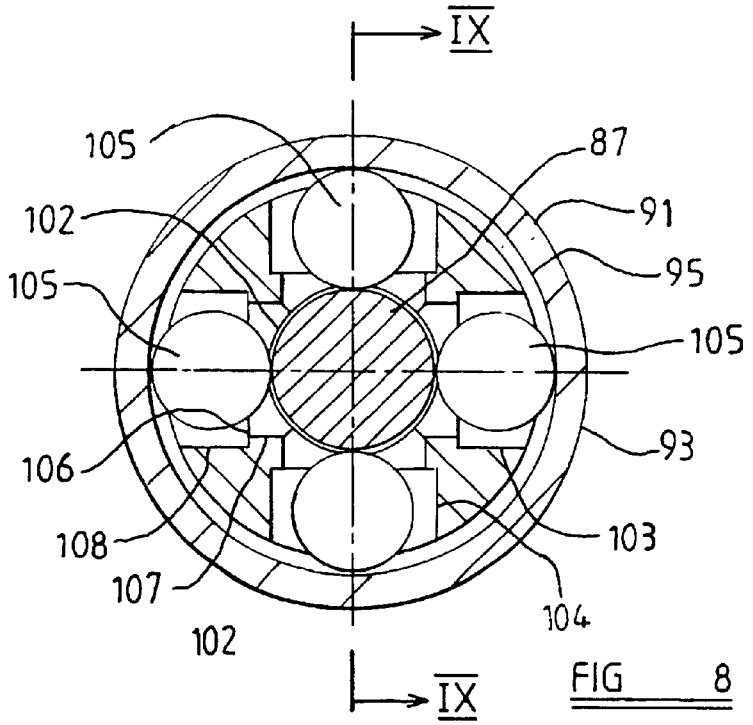
Figure 9:
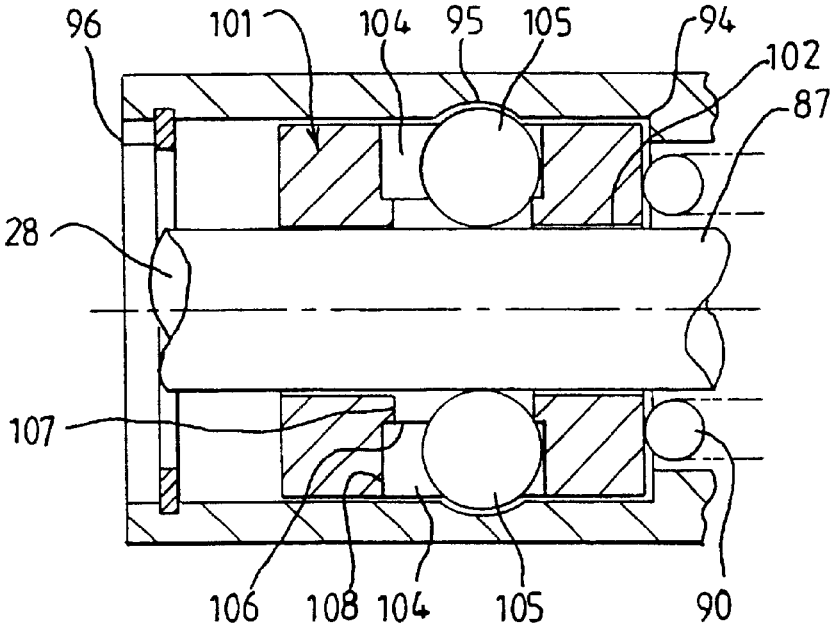
Figure 10:
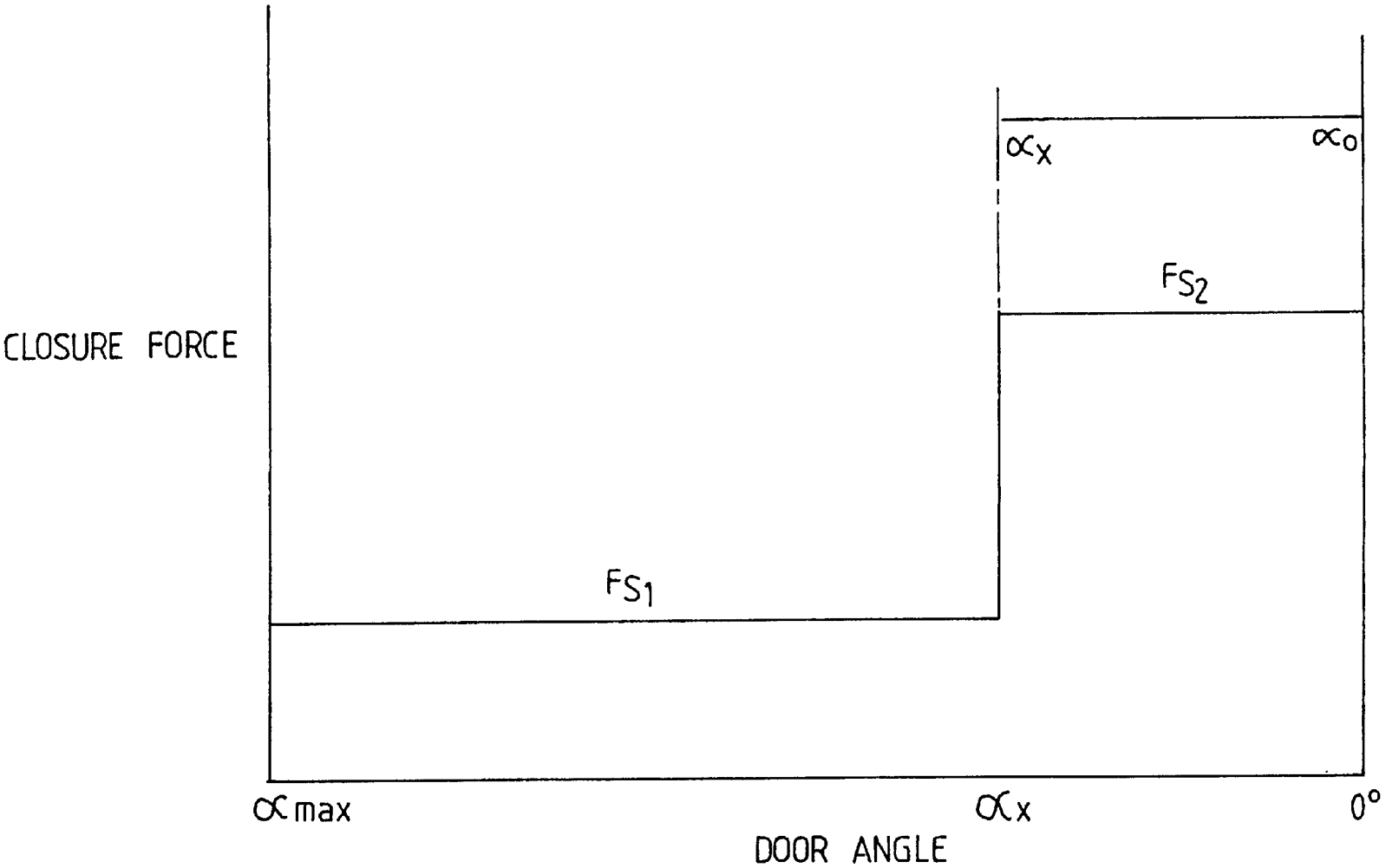
Figure 11:
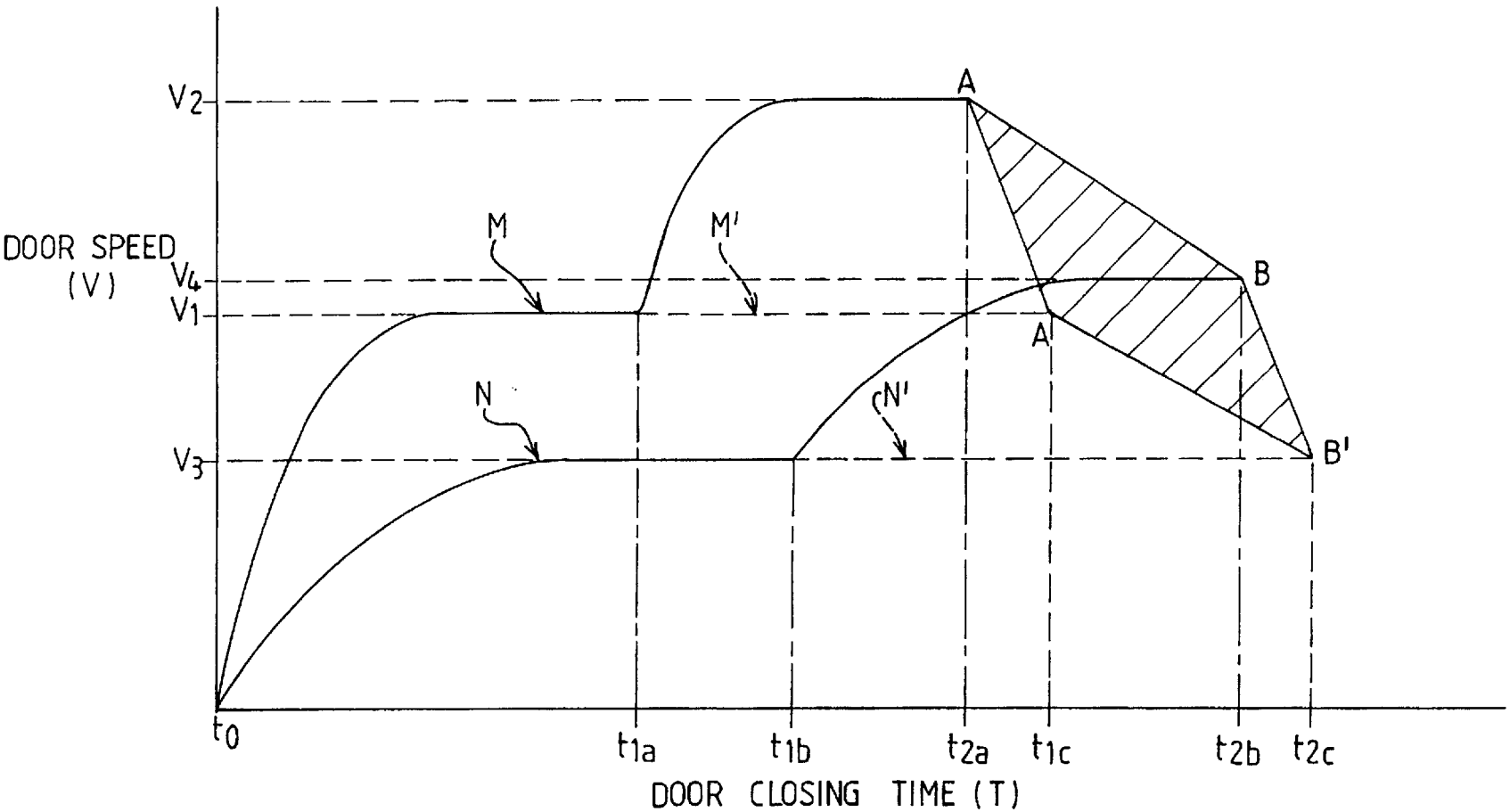

FIG. 6 is a longitudinal section on the line VI—VI of FIG. 1B showing the construction of thrust means in a first, compressed condition, FIG. 7 is a longitudinal section on the line VII—VII of FIG. 1A showing the construction of thrust means in a second, uncompressed condition, FIG. 8 is a transverse section on an enlarged scale on the line VIII—VIII of FIG. 6, FIG. 9 is a section on the line IX—IX of FIG. 8, FIG. 10 is a graph relating the closure force obtained from a closer in accordance with the invention to the angle of opening, and FIG. 11 is a graph relating the door closure speed to door closing time.

The door closer as illustrated in FIGS. 1 to 9 comprises an anchor assembly 10 which is adapted for mounting a door frame at a vertical edge thereof facing the hinged edge of a door hingedly carried by the frame, and an actuator assembly 20 which is adapted for mounting within the thickness of the door.

The anchor assembly 10 comprises a mounting plate 11 and an adjustment plate 12 which is spaced from the mounting plate on the side thereof remote from the door by an adjustable distance. An adjusting screw 13 is engaged in a threaded hole 14 formed in the adjustment plate 12 and a slotted head portion 15 of the screw bears against the mounting plate 12 and is accessible through a central hole 16 formed in the mounting plate 11. It will be understood that by rotation of the screw 13 the spacing of the adjustment plate 12 and mounting plate 11 can be varied for the purpose hereinafter described.

The mounting plate 11 is also formed with a pair of apertures 17 near the ends thereof and the adjustment plate 12 is formed with a pair of apertures 18 aligned with the apertures 17 whereby the adjustment plate 12 is coupled to an operating member 30 of the actuator assembly 20 as hereinafter described.

The actuator assembly 20 is so dimensioned as to be suitable for fitting within the thickness of the door and for this purpose is provided with a mounting member 21 having bosses near the outer ends thereof formed with apertures 22 which align with the apertures 17 of the anchor assembly mounting plate 11, a central boss formed with a bore 23, and intermediate bosses formed with a respective bore 24 having a reduced diameter portion intermediate the ends thereof, as shown clearly in FIG. 1A.

The apertures 22 locate therein fixed sleeves 25 which are provided with an external flange 26 abutting against the end face of the boss around aperture 22. The central bore 23 is partially threaded to receive a threaded end portion of a rod 27, and the intermediate bores 24 each locate one end of a respective shaft 28 secured therein by means of screws as shown. The sleeves 25, rod 27 and shaft 28 extend parallel to one another and the ends of the shafts 28 furthest from the mounting member 21 are supported by a transverse stop plate 29 which is secured to the free end of the rod 27 by means of a screw or the like.

The actuator assembly 20 further includes an operating member 30, as above-mentioned, which is carried by the mounting member 21 and guided for longitudinal movement by the sleeves 25, rod 27 and shafts 28. The operating member 30 includes a pair of parallel shafts 31 which are located in the sleeves 25, and each has at one end a pivotal connection 32 to a respective rigid link 33 which is disposed within the associated sleeve 25 when the closer is in the "door closed" condition as shown in FIG. 1A. The links 33 have a pivotal connection 34 with respective headed studs 19 which extend through the apertures 17 in the mounting plate 11 and through apertures 18 of the adjustment plate 12 of the anchor assembly 10. The links thus form an articulated connection between the shafts 31 and the anchor assembly 10.

The operating member 30 further includes, at the other end of the shafts 31, a cross-head 35 by which the shafts 31 are interconnected. The cross-head 35 is formed with outermost bosses with apertures 36 through which the shafts 31 extend and the cross-head is secured to the shafts 31 by means of pins (not shown). As seen most clearly in FIGS. 5, 6 and 7, the cross-head 35 is also formed with a central boss and a central aperture 37 in which the end of the rod 27 is located with a sealing ring, and a pair of intermediate bosses with apertures 38 through which the shafts 28 pass with clearance.

The operating member 30 is movable inwardly towards a retracted or "door closed" position as shown in FIG. 1A under the force of driving springs 45, which, in the illustrated embodiment, compromise coil springs extending between the cross-head 35 and the flanges 26 on the fixed sleeves 25. In addition, floating sleeves 40 are located on each of the shafts 31 and carry a respective clip 41 which engages between turns of the respective spring 45. Alternatively, separate springs may be provided on opposite sides of the clip 41.

As will be evident, the compression springs 45 act on the cross-head 35 to drive the latter inwardly of the actuator assembly 20 to the retracted position and to draw the shafts 31 and the associated links 33 inwardly so as to bring the mounting plate 11 of the anchor assembly 10 up to the mounting member 21 of the actuator assembly, in the manner illustrated in FIG. 1A, thereby holding the door in its closed position.

Figure 3:
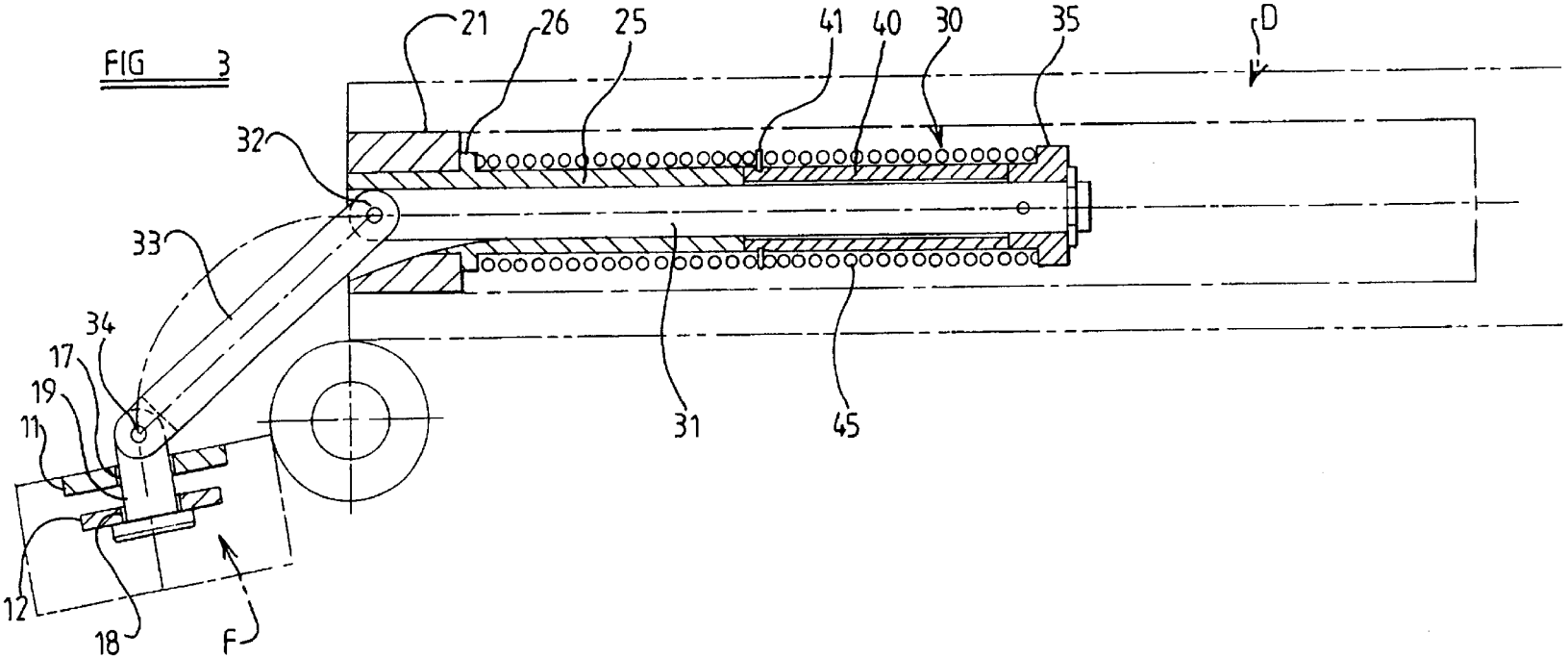
FIG. 3 is a horizontal section on the line III—III of FIG. 1B.

When the door is opened, as shown in FIGS. 1B and 3, the shafts 31 and cross-head 35 are drawn outwardly, thereby causing the springs 45 to be compressed, abutment of the floating sleeves 40 against the fixed sleeves 25 limiting the outward travel of the cross-head 35 at an extended or "door open" position. When the door is released, the coil springs 45 act to return the cross-head 35 and the shafts 31 to their starting positions, thereby bringing the door back to its closed position relative to the frame.

The actuator assembly 20 further includes a damper assembly 50 to regulate the rate of closure of the door under the action of the springs 45.

Figure 5:
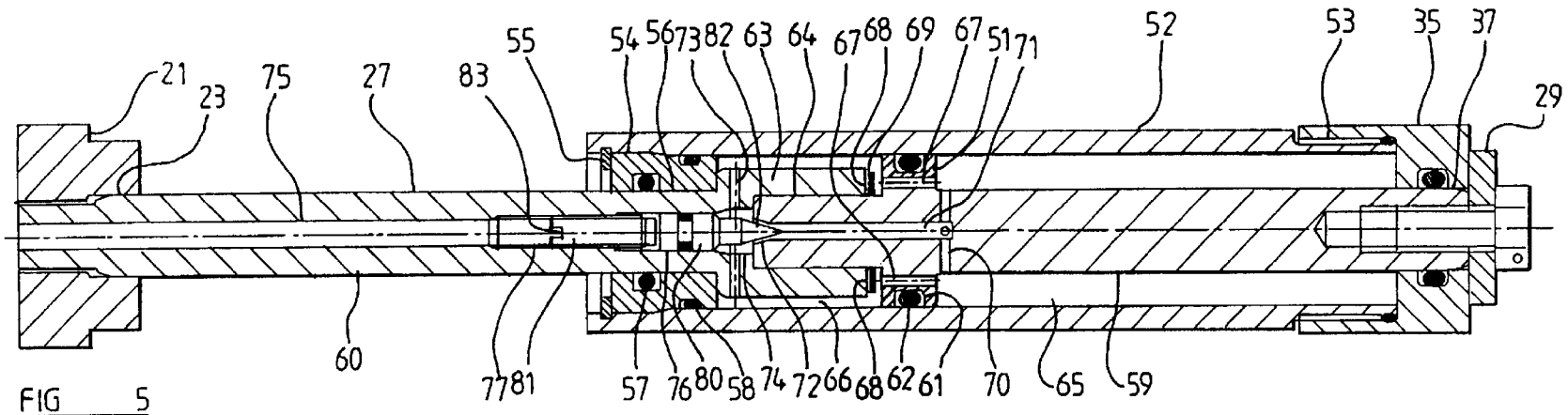
FIG. 5 is a longitudinal section through an adjustable damper assembly incorporated in the closer.

The damper assembly 50 as shown in FIG. 5 comprises a fixed piston 51 formed on the rod 27 at an intermediate position, and a cylinder 52 carried by the cross-head 35 and containing hydraulic fluid. The cylinder 52 is located at one end, with an appropriate seal, in a recess 53 formed in a boss at the centre of the cross-head 35, and is closed at its other end by a plug 54, which is retained by means of a clip 55 in the mouth of the cylinder. The plug 54 is formed with a bore 56 through which the piston rod 27 passes. Appropriate sealing rings 57, 58 are arranged to engage sealingly with the exterior surface of the rod 27 and with the interior surface of the cylinder 52 as shown.

In the illustrated embodiment the fixed piston rod 27 is assembled from first and second rod sections 59, 60. The first rod section 59 is formed with a radial enlargement having a peripheral groove 61 for a sealing ring 62 which engages with the interior face of the cylinder 52 so that the enlargement serves as the piston 51. The second rod section 60 includes a widened end portion 63 which has in internal bore 64 to receive an end portion of the first rod section 59.

The piston 51 divides the cylinder 52 into inner and outer compartments 65, 66 and fluid passageways as hereinafter described are formed in the piston 51 and the rod 27 to enable hydraulic fluid to pass from one compartment of the cylinder to the other in a controlled manner.

Axial passageways 67 extend directly between opposite faces of the piston 51. The widened end portion 63 of the second rod section 60 has an end face 68 which is spaced axially from the piston 51, and a flexible seal 69 is disposed between the end face 68 and the piston 51. The flexible seal 69 is moveable within the gap between the end face 68 and the piston 51 in response to fluid pressure so to close or open the axial passageways 67.

The flexible seal 69 lifts from the ends of the axial passageways 67 in response to opening movement of the door, so that fluid may flow freely from the inner compartment 65 to the outer compartment 66 and the door may be opened freely. However, in response to movement of the door towards its closed position the flexible seal 69 covers the ends of the axial passageways 67 in such a manner as to prevent liquid flowing directly from the outer compartment 66 to the inner compartment 65 through the axial passageways 67.

To enable fluid to flow from the outer compartment 66 to the inner compartment 65, radial passageways 70 are formed in the first rod section 59 adjacent to the face of the piston which is presented towards the cross-head 35 to communicate with a central bore 71 which terminates, at the end of the first rod section 59 which is presented towards the mounting member 21, in a throttling orifice 72. Further radial passageways 73 extend from the outer face of the widened end portion 63 of the outer rod portion 60 to a central chamber 74 formed at the inner end of an axial bore 75 which extends through the second rod section 60 to its outer end where it is received in the central bore 23 of the mounting member 21.

The axial bore 75 includes a widened end portion 76 adjacent to the central chamber 74, and an internally threaded portion 77 adjacent to the widened end portion 76. The widened end portion 76 receives an adjustable throttle member 80 which includes an externally threaded shank portion 81 received within the internally threaded portion 77 of the bore 75, and a needle port ion 82 which co-operates with the orifice 72. The shank portion 81 of the throttle member 80 is formed with slot 83 to receive the end of a screwdriver blade which can be inserted along the bore 75, to enable the throttle member 80 to be rotated to adjust the axial position of the needle portion 82 relative to the throttle orifice 72 to provide a variable restriction.

When the passageways 67 are closed by the flexible seal 69, communication between the two compartments of the cylinder 52 is only possible through passageways 70, 71 and 73, and the throttling orifice 72. In this way, the orifice 72 serves as an adjustable throttle to regulate the flow of fluid from the outer compartment 66 to the inner compartment 65 as the cross-head 35 is driven inwardly of the actuator assembly by the compression springs 45. The rate at which the door is closed under the force of the springs 45 can thus be adjusted, and it is particularly to be noted that such regulation is effective throughout the entire range of movement of the operating member 30 from the extended position shown in FIG. 1B to the retracted position shown in FIG. 1A. However, on the reverse stroke, when the door is being opened, the flexible seal 69 is able to lift from the ends of the axial passageways 67 and allow relatively unrestricted flow of fluid between the two compartments.

The actuator assembly 20 further includes a pair of thrust assemblies 85 mounted on the shafts 28 disposed between the respective driving springs 45 and the damper assembly 50.

As can best be seen from FIGS. 6 and 7 an innermost end portion 86 of each shaft 28 is of slightly greater diameter than the outermost end portion 87 so as to form an outwardly facing shoulder 88 at the junction between the two portions. A groove 89 is formed around the narrower portion 87 of each shaft 28 at a predetermined spacing from the shoulder 88.

The thrust assemblies 85 each include a thrust spring 90 located on the respective shaft 28 and within a cylinder 91 concentric with the shaft. Each cylinder 91 is fixed in a recess 92 formed in the intermediate boss of the cross-head 35, and serves as a guide for the thrust spring 90. The thrust springs 90 are strong compression springs having a rate greater than that of the coil springs 45.

An internally widened end portion 93 of each cylinder 91 forms an outwardly facing shoulder 94, and internally the widened end portion 93 is formed with a circumferential groove 95 at a predetermined spacing from the shoulder 94. The arrangement is such that when the cross-head 35 abuts the stop plate 29 as shown in FIG. 7, the groove 95 in the cylinder 91 is longitudinally offset relative to the groove 89 formed in the shaft 28, so as to be somewhat further from the mounting member 21. The widened end portion 93 of each cylinder 90 is fitted with a retaining clip 96.

A control mechanism 100 is provided whereby said thrust springs 90 are employed to augment the force of the driving springs 45. The control mechanism includes in each cylinder 91 a carrier block 101 which is held in contact with the retaining clip 96 by engagement with the thrust spring 90. As best seen in FIGS. 8 and 9, the carrier block 101 is formed with a central bore 102 whereby it is slidable on the narrower portion 87 of the shaft 28. The carrier block 101 is also formed with two intersecting transverse bores 103, 104 which contain four balls 105 in the respective radial arms thereof. The transverse bores 103, 104, balls 105 and grooves 89 and 95 are so dimensioned that the balls 105 may be displaced radially to seat in either the groove 89 formed on the shaft 28, or in the groove 95 formed in the cylinder 91.

As can be seen from FIG. 7, when the door closer is in its closed condition the balls 105 are located in the groove 89 formed in the shaft 28, and they are held in this position by engagement of the balls 105 with the interior surface of the widened end portion 93 of the associated cylinder 91 at a point spaced outwardly from the groove 95 by a small distance. The balls thus act as a detent means which holds the carrier block 101 in a pre-determined position on the shaft 28, in which position the carrier block is spaced from the shoulder 94 in the cylinder 91 and the thrust spring 90 is in a relatively extended condition.

As the door is opened, the cross-head 35 and cylinders 91 move outwardly (i.e. to the left as shown in FIG. 7) so that the thrust springs 90 are immediately compressed against the carrier blocks 101, which are held in fixed positions on the shafts 28 by engagement of the balls 105 in the grooves 89, since the balls 105 are held against outward displacement by engagement with the interior surface of the cylinders 91.

However, the groove 95 in each cylinder 91 is so disposed relative to the shoulder 94 that when the shoulder 94 comes into engagement with the stationary carrier block 101, the groove 95 is then in alignment with the transverse bores 103, 104 in the carrier block 101, thereby allowing balls 105 to move radially outwardly. Continued outward movement of the cylinder 91 can thus drive the carrier block 101 outwardly along the shaft 28, and displace the balls 105 radially outwardly into the grooves 95 as shown in FIG. 6.

As outward movement of the cylinder 91 continues, the balls 105 are held within the groove 95 by engagement with the exterior surface of the outermost portion 87 of the shaft 28. At this time, the carrier block 101 is held in a fixed position relative to the cylinder 91 (i.e. against the shoulder 94), by the detent action of the balls 105 in the grooves 95, thereby holding the thrust springs 90 in a compressed condition, as shown in FIG. 6.

As shown most clearly in FIGS. 7 and 8, the radial bores 103, 104 are each of stepped form, with an internal shoulder 106 at the junction between an inner portion 107, which is of such a diameter as to accommodate the ball 105 with minimum clearance, and a somewhat widened outer portion 108. The shoulder 106 of each bore is spaced from the surface of the shaft 28 by a distance which is slightly less than the radius of the ball 105. The effect of this is that the shoulder 106 assists in retaining the ball in the groove 95 while relieving the pressure exerted by the ball on the shaft 28. This facilitates movement of the carrier blocks 101 along the shafts 28 by reducing friction, since the balls 105 are pressed laterally against the shoulder 106 as shown in FIG. 9 in such a manner as to apply a radially outwardly directed force to the ball, thereby holding it in the groove 95 while at the same time relieving the pressure exerted by the ball on the shaft 28.

In operation, the thrust springs 90 are initially in a relatively unstressed condition as shown in FIG. 7 while the door is closed and are compressed during the initial stages of the opening movement of the door through a distance corresponding to movement of the shoulders 94 within the cylinders 90 into engagement with the carrier blocks 101 while the carrier blocks are held in fixed positions on the shafts 28. The thrust springs 90 are then held in that compressed condition, as shown in FIG. 6, throughout the remainder of the movement while the carrier blocks 101 are held in fixed positions in the cylinders 91 and travel with the cylinders, along the shafts 28.

When the door closes subsequently under the action of compression springs 45, the carrier blocks 101 are initially retained in their fixed positions within the cylinders 91, since the balls 105 continue to be held within the grooves 95 by the shaft 28 and the thrust springs 90 are maintained in their stressed condition. But when the transverse bores 103, 104 of the carrier blocks 101 again come into register with the grooves 89 formed in the shafts 28, some way before the door reaches its closed position, at this point the balls 105 are free to move radially inwardly into the grooves 89, thereby moving out of the grooves 95 formed in the cylinders 91, and releasing the cylinders relative to the carrier blocks 101. The carrier blocks 101 are then held in a fixed position relative to the shafts 28, and the thrust springs 90, acting on the now fixed carrier blocks 101 exert an augmented driving force on the cross-head 35 over the final part of its range of movement as the shoulders 94 of the cylinders 91 move away from the carrier blocks 101 as shown in FIG. 7.

The adjustment plate 12 enables the point at which the thrust springs 90 come into operation to be varied. Adjustment of the adjustment plate 12 relative to the mounting plate 11 of the anchor assembly 10 alters the angular position of the door at which the balls 105 become aligned with the grooves 89 in the shafts 28 by varying the spacing between the mounting plate 11 of the anchor assembly 10 and the cross-head 35 of the operating member 30. In this way the fixed position of the grooves 98 corresponds to any selected position of the mounting plate 11 within a predetermined range of positions. Typically, the range of adjustment may be between 0 and about 15° of opening. Thus at one extreme, the thrust springs may be rendered ineffective if desired, whilst the range of angular movement over which they are effective, when required, can be set at up to 15° or thereabouts according to the precise geometry adopted.

This is illustrated in FIG. 10, in which the total force (F) exerted on the operating member 30 is shown relative to the angle of opening ($\alpha$). As can be seen from the maximum angle of opening ($\alpha_{max}$) to an adjustable angle ($\alpha_x$) the force is at an ideally constant value ($F_{S1}$). At the point ($\alpha_x$) the force increases sharply to an augmented value ($F_{S2}$) and ideally remains at that value throughout the remainder of the range of movement to the position of closure represented by ($\alpha_0$). The angle ($\alpha_x$) may be varied between zero ($\alpha_0$) and typically about 15° as previously described.

In practice, the damper assembly 50 is, however, operative over the entire range of movement of the operating member 30 up to the "door closed" position to provide a controlled and adjustable rate of closure and thus a variable time to closure from any initial angle of opening as previously described, and the forces exerted by the closer are not constant during each part of the closing movement as illustrated in FIG. 10. Thus in a typical embodiment with the main springs 45 fully compressed the closing force is initially 1040 Newtons (234 lbs.) whereas at approximately 16° opening angle and just prior to engagement of the thrust springs 92 the force is 612 Newtons (137 lbs.) whilst at 14° when the thrust springs have come into operation the force is increased to a total of 1308 Newtons (294 lbs.) of which 718 Newtons arises from the thrust springs.

The effect of the damper is illustrated in FIG. 11 which shows the door closing speed (V) plotted against door closing time (T) from the position of maximum opening to closure, with minimum and maximum damping and an indication of the variable range of operation of the thrust springs.

With the damping set at minimum, and the action of the thrust springs set at maximum, the door speed follows the upper solid line curve (M), from which it can be seen that at time= to the door accelerates from rest to a uniform velocity $V_1$ and at time=$t_{1a}$ the thrust springs become effective with the result that the door speed increases to a higher velocity $V_2$ until at point A the door reaches its position of closure at time=$t_{2a}$.

If the damping is set at the maximum value, the door speed follows the lower solid line curve (N) to a lower velocity $V_3$ and the thrust springs become effective at time=$t_{1b}$ following which the door speed increases to a value $V_4$ until at point B the door reaches its position of closure at time $t=t_{2b}$.

However, if the thrust springs are rendered inoperative by appropriate adjustment of the plate 12, when the damping is set at minimum the door continues to close at velocity $V_1$ as indicated by the broken line M' until at point A' it reaches its position of closure at time $t=t_{1c}$ whereas when the damping is set at maximum the door continues at velocity $V_3$ as indicated by broken line N' until at point B' it reaches its position of closure at time=$t_{2c}$.

The shaded area bounded by points A, A', B and B' represents the envelope within which the closure time can be varied by the combined adjustments available by means of the adjustment plate 11 and the adjustable throttle incorporated in the damper assembly 50.

Thus at all times during the closing action, the rate of movement of the door is controlled by the damper assembly 50 but, as illustrated in FIG. 10, the closing force applied by the driving springs 45 can be substantially augmented from $F_{S1}$ to $F_{S2}$ by the thrust springs 90 over a variable final part ($\alpha=\alpha_x$ to $\alpha_0$) of the closure movement, thus overcoming any resistance to closure which may be imposed by a latching mechanism operating between the door and door frame, but without the potentially excessive "snap action" associated with previous door closures of the kind in which the flow restriction imposed by the damper assembly is relieved during the final part of the closure movement. However, adjustment of the damper makes it possible to provide a controlled degree of snap action, when the flow restriction is set to a minimum, or a "soft" action, when die flow restriction is set to a maximum, or anything in between.

Adjustment of the position of the adjustment plate 12 of the anchor assembly 10 varies the effective length of the connection between the cross-head 35 and the anchor assembly, and can thus also enable the action of the thrust springs 90 to cut in at the correct point despite variations in the width of the gap between the inner edge of the door and the door flame in different installations.

The door closer as above described is fully adjustable with respect to the selected range of angular movement over which the augmented closure force is applied, and with respect to the degree of damping applied, whilst being particularly compact so that it can be installed in a door without compromising the fire resistance of the door.

The features disclosed in the foregoing description, or the following claims, or the accompanying drawings, expressed in their specific forms or in terms of a means for performing the disclosed function, or a method or process for attaining the disclosed result, as appropriate, may, separately, or in any combination of such features, be utilised for realising the invention in diverse forms thereof.

What is claimed is:

1. A door closer comprising in combination:

an anchor member (10) for mounting on a door frame, an actuator assembly (20) for mounting within the thickness of a door which is hinged for movement between open and closed positions relative to said door frame, an operating member (30) coupled by an articulated link (33) to said anchor member (10) and mounted in said actuator assembly (20) for a range of movement between a retracted position in which said anchor member (10) is held immediately adjacent to said actuator assembly (30) and an extended position in which said anchor member (10) is held in spaced relation to said actuator assembly (30), resilient driving means (45) arranged to exert a driving force on said operating member (30) in a manner such as to drive said operating member towards said retracted position and thereby draw said anchor member (10) and said actuator assembly (20) together such that, when installed, the door closer acts to draw the door into its closed position relative to the frame, a damper (50) connected to said operating member so as to control the rate of movement of the operating member (30) in at least a direction towards said retracted position, said damper comprising a cylinder

(52) containing hydraulic fluid, a piston rod (27) carrying a piston (51) which divides the cylinder (52) into two chambers (65, 66), and flow-restricting means (70–83) to limit the rate of flow of hydraulic fluid from one of said chambers to the other at least in one direction of fluid flow in response to movement of said operating member towards said retracted position, an adjustable throttle, which comprises two elements (72, 82) in combination, the flow restriction imposed on the hydraulic fluid by said throttle being variable by relative positional adjustment of said two throttle elements, and an adjustment member (80) to enable one of said throttle elements to be positionally adjusted relative to the other so as to vary the flow restriction imposed on the hydraulic fluid by said throttle, resilient thrust means (85) arranged to exert an increased driving force on said operating member (30), control means (100) whereby said thrust means (85) is operative to apply said increased driving force to said operating member (30) over a defined part of said range of movement as said operating member (30) approaches said retracted position, corresponding to movement of the door over the final part of its movement into its closed position, and an adjustment member (12) operatively connected with said control means (100) to vary the point in the range of movement of said operating member at which said resilient thrust means (85) becomes operative to apply said increased driving force.

2. A door closer according to claim 1 wherein said control means (100) includes detent means (105) arranged to hold said thrust means (85) in a stressed condition over the whole of the range of movement of the operating member (30) apart from said defined part of said range.

3. A door closer according to claim 2 wherein said thrust means (85) includes a compression spring (90) located within a guide member (91) which is coupled to said operating member (30) and slidable therewith along a fixed shaft (28), and said detent means (105) is provided on a carrier member (101) which is retained within said guide member (91) to abut one end of said compression spring (90) and is slidable on said fixed shaft (28) and located within said guide member (91) for limited movement longitudinally thereof, the detent means (105) being engagable in an internal recess (95) formed within said guide member (91) to hold the compression spring (90) in a compressed condition, and being displaceable from a position of engagement with said internal recess (95) to release said compression spring (90) at a predetermined position along said shaft (28) so as to apply said increased driving force to said operating member (30).

4. A door closer according to claim 3 wherein said detent means (105) is displaceable from said position of engagement with said internal recess (95) in said guide member (91) into a position of engagement with an external recess (89) formed in said shaft (28) to hold said carrier member (101) in a predetermined position on said shaft (28).

5. A door closer according to claim 4 wherein said detent means comprises a plurality of balls (105) located in one or more transverse bores (103, 104) formed in said carrier member (101).

6. A door closer according to claim 5 wherein each of said balls (105) is of a diameter greater than the radial spacing between an exterior face of said shaft (28) and an interior face of said guide member (91) so that said balls (105) are either held by said shaft (28) in said internal recess (95) formed in said guide member (91) or by said guide member (91) in said external recess (89) formed in said shaft (28).

7. A door closer according to claim 6 wherein the bores (103, 104) in which the balls (105) are located are formed with a radially innermost portion (107) having a diameter such as to accept the ball with a slight clearance and a radially outermost portion (108) having a greater diameter, the two portions meeting at an internal shoulder (106) disposed at a spacing from the shaft (28) which is less than the radius of the ball (105).

8. A door closer according to claim 7 wherein said cylinder (52) of said damper (50) is moveable relative to said actuator assembly (20) and is coupled to said operating member (30), and said piston (51) is static.

9. A door closer according to claim 8 wherein said flow-restricting means (70–83) is incorporated into said piston (51) and piston rod (27), and said adjustment member (80) has an operating element (83) which is accessible from one end of said piston rod (27).

10. A door closer according to claim 9 wherein said adjustment member (80) comprises a shaft located within an axial bore (75) formed in said piston rod (27), with an external threaded formation (81) engaging an internal threaded formation (77) in the bore of the piston rod whereby rotation of the adjustment member (80) varies its axial position within said bore (75).

11. A door closer according to claim 10 wherein said adjustment member (80) is provided at one end with a needle formation (82) which comprises one of said throttle elements to co-operate with an orifice (72) defined by the other of said elements, and at its other end with a head formation (83) whereby the adjustment member (80) may be rotated.

12. A door closer according to claim 7 wherein said thrust means (85) includes one or more spring elements (90) having a higher rate than said resilient driving means (45).

13. A door closer according to claim 12 wherein both said driving means (45) and said thrust means (85) comprise one or more coiled compression springs (45, 90).

14. A door closer according to claim 13 wherein said thrust means (85) and said driving means (45) each comprise two spring elements (45,45: 90,90) which extend in side by side parallel relationship and disposed symmetrically relative to said damper means (50).

15. A door closer according to claim 14 wherein said thrust means (85) are disposed between said driving means (45) and said damper means (50).

* * * * *

UNITED STATES PATENT AND TRADEMARK OFFICE

CERTIFICATE OF CORRECTION

PATENT NO. : 6,625,847 B1
DATED : September 30, 2003
INVENTOR(S) : Jones, Barrie It is certified that error appears in the above-identified patent and that said Letters Patent is hereby corrected as shown below:

Column 3,
Line 7, “engagable” should read -- engageable --
Line 56, “Belville” should read -- Belleville --

Column 5,
Line 61, “centre” should read -- center --

Column 6,
Line 51, “port ion” should read -- portion --

Column 9,
Line 49, “time= to” should read -- time=$t_0$ --

Column 10,
Line 20, “die” should read -- the --
Line 40, “utilised” should read -- utilized --; and “realised” should read -- realized --

Column 11,
Line 44, “engagable” should read -- engageable --

Column 12,
Line 51, “and disposed” should read -- and are disposed --
Line 54, “are” should read -- is --

Signed and Sealed this

Thirteenth Day of January, 2004

JON W. DUDAS
*Acting Director of the United States Patent and Trademark Office*